US005664835A

United States Patent [19]

Desanta

[11] Patent Number: 5,664,835

[45] Date of Patent: Sep. 9, 1997

[54] CHAIR

[75] Inventor: Simon Desanta, Borgholehausen, Germany

[73] Assignee: Peter Roeder, Frankfurt, Germany

[21] Appl. No.: 549,733

[22] PCT Filed: Mar. 24, 1995

[86] PCT No.: PCT/EP95/01126

§ 371 Date: Nov. 27, 1995

§ 102(e) Date: Nov. 27, 1995

[87] PCT Pub. No.: WO95/26152

PCT Pub. Date: Oct. 5, 1995

[30] Foreign Application Priority Data

Mar. 25, 1994 [DE] Germany ..... 44 10 383.2

[51] Int. Cl.[6] ..... A47C 1/032

[52] U.S. Cl. ..... 297/302.1; 297/353; 297/452.15; 297/325

[58] Field of Search ..... 297/302.1, 302.3, 297/302.7, 325, 353, 452.14, 452.15

[56] References Cited

U.S. PATENT DOCUMENTS

| | | | |
|---|---|---|---|
| D. 164,204 | 5/1951 | Smith . | |
| D. 344,649 | 3/1994 | Wilcox et al. . | |
| D. 346,279 | 4/1994 | Stumpf et al. . | |
| 219,589 | 9/1879 | Mayo | 297/452.15 |
| 2,281,341 | 4/1942 | Turner . | |
| 2,439,690 | 4/1948 | Lippenberger . | |
| 2,530,924 | 11/1950 | Turner | 297/452.15 |
| 2,616,484 | 11/1952 | Christie | 297/302.1 |
| 3,131,970 | 5/1964 | McGregor . | |
| 3,297,360 | 1/1967 | Holmstrom . | |
| 3,309,137 | 3/1967 | Wiebe . | |
| 3,743,353 | 7/1973 | Lupinsky . | |
| 4,380,352 | 4/1983 | Diffrient . | |
| 4,451,085 | 5/1984 | Franck et al. . | |
| 4,647,109 | 3/1987 | Christophersen . | |
| 4,660,887 | 4/1987 | Fleming et al. . | |
| 4,790,598 | 12/1988 | Locher . | |
| 4,889,385 | 12/1989 | Chadwick et al. . | |
| 4,892,356 | 1/1990 | Pittman et al. . | |
| 5,015,038 | 5/1991 | Mrotz, III . | |
| 5,033,791 | 7/1991 | Locher . | |
| 5,039,164 | 8/1991 | Gibbs . | |
| 5,040,847 | 8/1991 | Nguyen . | |
| 5,203,853 | 4/1993 | Caruso . | |
| 5,284,380 | 2/1994 | Gehry . | |
| 5,366,273 | 11/1994 | Bresch | 297/452.63 X |
| 5,425,566 | 6/1995 | Buchacz | 297/353 X |

FOREIGN PATENT DOCUMENTS

| | | | |
|---|---|---|---|
| 1172775 | 8/1984 | Canada . | |
| 0216578 | 4/1987 | European Pat. Off. . | |
| 0264029 | 4/1988 | European Pat. Off. . | |
| 0284272 | 9/1988 | European Pat. Off. . | |
| 756260 | 12/1933 | France . | |
| 2700450 | 7/1994 | France . | |
| 477090 | 6/1929 | Germany . | |
| 1169625 | 5/1964 | Germany . | |
| 6924621 | 10/1969 | Germany . | |
| 8001161U1 | 5/1980 | Germany . | |
| 4033544 | 4/1992 | Germany . | |
| 73218 | 3/1948 | Norway . | |
| 363621 | 12/1931 | United Kingdom | 297/302.1 |
| 396138 | 8/1933 | United Kingdom . | |
| 1046574 | 10/1966 | United Kingdom . | |

*Primary Examiner*—Peter R. Brown
*Attorney, Agent, or Firm*—Spencer & Frank

[57] ABSTRACT

A chair with a moveable seat panel mounted springingly on a support and a back-rest has a seat panel made from pliant panel material which is guided down around the front edge of the seat panel in a U-shape and then rigidly sandwiched in the support. A guide bar which is pivotably mounted on the support is directed backwards and is rigidly connected with the underside of the rear end portion of the seat panel.

10 Claims, 2 Drawing Sheets

CHAIR

BACKGROUND OF THE INVENTION

The invention relates to a chair with a moveable seat panel mounted springingly on a support, and a back-rest.

Over the last few years, office chairs have been developed to a high level with respect to functionality, ergonomic characteristics and durability. Naturally, this has resulted in ever more complicated, heavier and also more expensive constructions.

The task of this invention is to create a simple, light chair which is inexpensive to manufacture and, despite being of a simpler construction, provides comfortable seating whilst meeting ergonomic requirements.

SUMMARY OF THE INVENTION

According to the invention, this task is solved for a chair of the above-mentioned type in that the seat panel is made from thin, pliant panel material which is guided down around the front edge of the seat panel in a U-shape and then rigidly sandwiched in the support.

Plywood or various plastic materials could, for example, be used for this type of pliant, flexible panel material.

As an additional guide for the seat panel it is useful to provide, between the rear portion thereof and the support, at least one guide bar that is pivotably connected with the support and rigidly connected to the underside of the rear portion of the seat panel, and which causes the rear portion of the seat panel to flex into position along a pre-determined path, and, when the seat panel flexes into position, forces it into an essentially S-shaped bend, which results in an ergonomically advantageous adaptation to the user's body shape.

The back-rest is also preferably made from a flexible, panel-shaped material. It is preferably connected with the rear end of the seat panel.

A guide allowing the back-rest to be vertically adjusted is preferably mounted at the rear end of the guide bar.

BRIEF DESCRIPTION OF THE DRAWINGS

Preferred embodiments of the invention will be described in more detail below with reference to the enclosed drawings, in which.

DETAILED DESCRIPTION OF THE INVENTION

Figure 1:
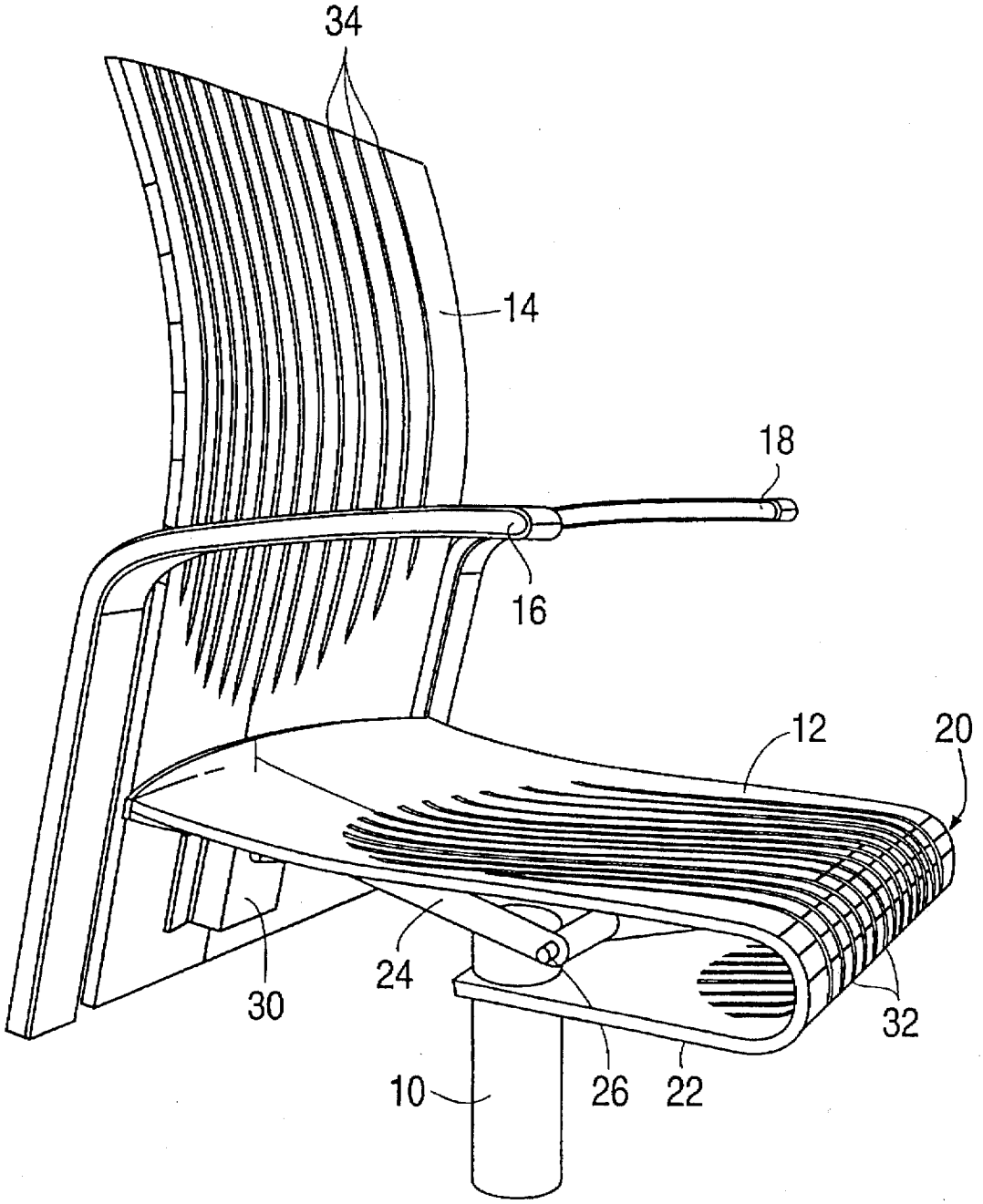
FIG. 1 is a perspective diagrammatic partial view of a chair according to the invention.

FIG. 1 shows a chair according to the invention, with a vertical pillar 10 forming the support, with a rotating base at the bottom end (not shown), a seat panel 12 and a back-rest 14, as well as two arm-rests 16 and 18. A different support, e.g. a support with four legs, can be used instead of the pillar 10.

The seat panel 12 is made from a thin, pliant panel material which is bent down in a U-shape around the front edge, designated by the reference number 20, of the seat panel 12, and is rigidly sandwiched in the top portion of the pillar 10 with its lower, now again rearwardly directed section 22. This results in a strong, but—thanks to the flexibility of the panel material of seat panel 12—springingly pliant mounting for the seat panel 12 when the chair is used by one person.

To additionally support and guide the seat panel 12, the example illustrated shows two parallel guide bars 24 which are pivotably mounted in an axle 26 at the top end of the pillar 10 and from there are slopingly inclined backwards and upwards. These guide bars 24 are rigidly attached underneath the rear end portion of the seat panel 12, as shown more precisely in FIG. 2. This ensures that the rear end of the seat panel 12 is accurately guided as its flexes into position, and furthermore, when it flexes into position, the seat panel 12 is also forced by the rigid connection with the guide bars 24 into an essentially S-shaped bend which has been shown to be very ergonomically and anatomically advantageous. This S-shaped bend is based on the fact that when the guide bars 24 move downwards, at least the rear edge portion of the seat panel always runs parallel to the guide bars and therefore, in the rearwardly lowered position, the panel only rises in the centre portion in an S-shape towards the level of the front edge.

Figure 2:
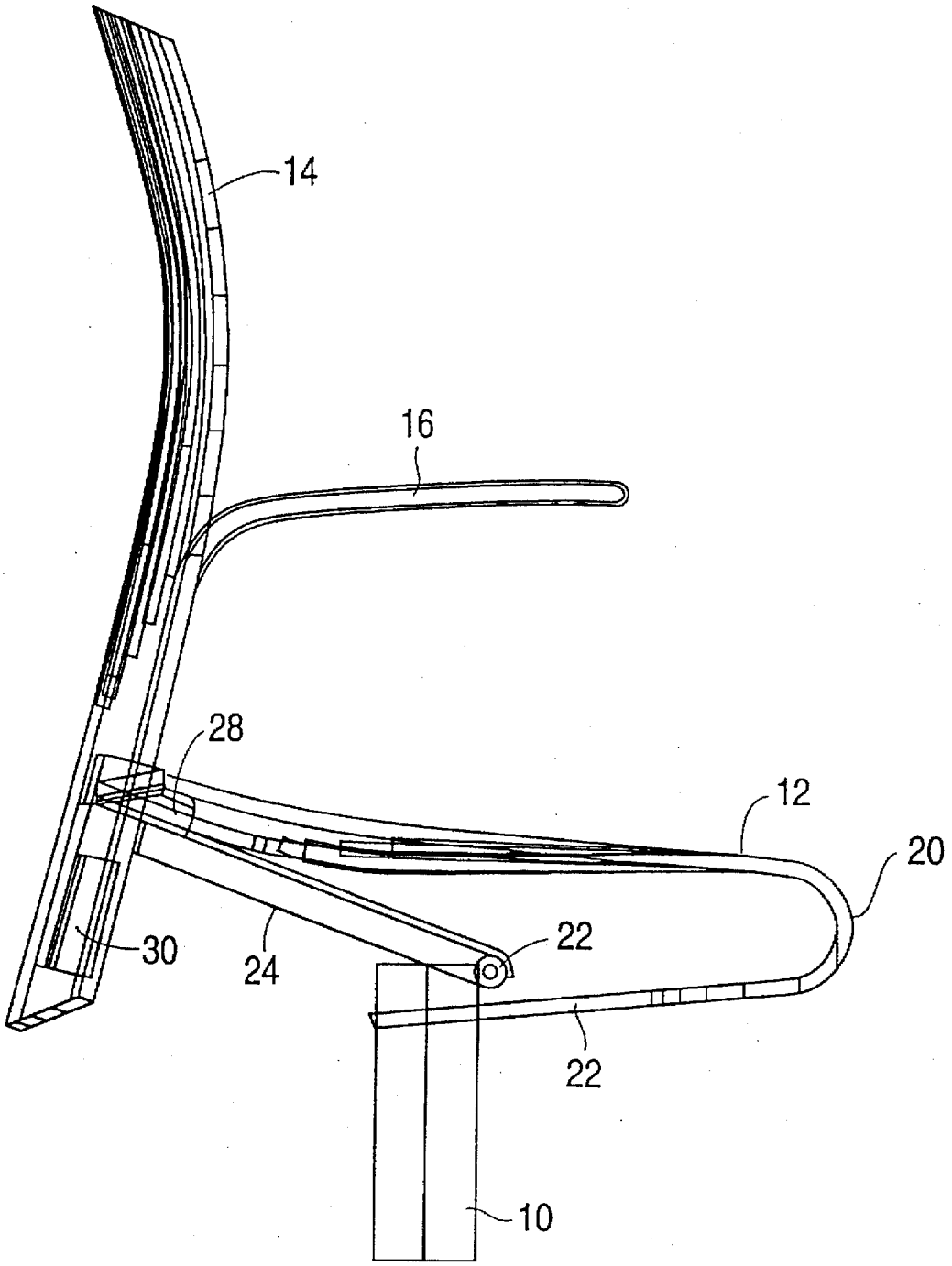
FIG. 2 is a corresponding diagrammatic partial side view.

FIG. 2 indicates connecting mountings 28, which rigidly connect the guide bars 24 to the rear end portion of the seat panel 12 over a certain length.

Rigidly connected to these mountings 28 resp. the rear end of the guide bars 24, there is also a vertical guide device 30, which vertically displaceably accommodates the back-rest 14, so that the height of the back-rest 14 can be separately adjusted. This allows the height of the chair user to be taken into account.

To improve flexibility, the panel-shaped material of the seat panel 12 and also of the back-rest 14, which can be made from, for example, plywood or a suitable, appropriately flexible plastic, can be sub-divided into individual, parallel strips by a plurality of grooves 32,34 contrived in the longitudinal direction of the chair. This strip formation immediately increases the flexibility in the lateral direction of the seat panel 12 and back-rest 14, therefore improving the adaptation to the user's body form.

The invention makes it possible to use the inherent elasticity of the panel material, particularly of a plywood panel, not just in the direct area of the seat panel, but more broadly, in the manner of a spring. Thus a chair mechanism is created that meets the usual requirements with regard to seating comfort and adjustment options, which functions without using a single extra spring. Relatively simple, inexpensive chairs with a high level of user comfort can also be manufactured.

I claim:

1. A chair comprising:

a resilient seat panel mounted on top of a support, a back-rest located at a rear portion of the seat panel, the seat panel being made from thin, pliant panel material, the material being guided down around a front edge of the seat panel in a U-shape and being rigidly attached to the support, and at least one guide bar having one end pivotably mounted at the support so that the guide bar can pivot about a fixed stationary axis located at the support, said guide bar being directed backwards from the support and having a second end rigidly attached with an underside of the seat panel in the rear portion thereof, said guide bar causing said seat panel to flex into a desired shape when a user sits on the chair.

2. The chair of claim 1, further comprising a guide device connected with the second end of the guide bar, the back-rest being essentially vertically displaceably accommodated in the guide device.

3. The chair of claim 1, wherein the panel material of the seat panel is sub-divided into a plurality of parallel strips by parallel grooves running in the forwards-backwards direction of the chair.

4. The chair of claim 1, wherein the back-rest is made from pliant panel material.

5. The chair of claim 4, wherein the panel material of the back-rest is sub-divided into a plurality of parallel strips by parallel, vertical grooves.

6. The chair of claim 1, wherein the panel material of the seat panel is made from plywood or plastic.

7. The chair of claim 6, wherein the panel material of the back-rest is made from plywood or plastic.

8. A chair, comprising:

a support extending generally in a vertical direction;

a seat having a front portion and a rear portion, and being resiliently mounted on said support, said seat being composed of a thin, pliant material, and having:

a lower, essentially horizontal panel rigidly attached to said support, and;

an upper, essentially horizontal panel located above said support and being contiguously connected to said lower panel along the front portion of said seat to form a U-shape; and at least one guide bar having a first end pivotably connected to said support so that the guide bar can pivot about a fixed stationary axis located at the support, and a second end rigidly connected to an underside of said upper panel in the rear portion of said seat, said guide bar causing said seat to flex into a desired shape when a user sits on the chair.

9. The chair defined in claim 8, further comprising a back rest located at the rear portion of said seat.

10. The chair defined in claim 8, further comprising a guide device attached to the second end of said guide bar, and a back rest vertically displaceably accommodated in said guide device.

* * * * *